US006874705B2

(12) United States Patent
Parche

(10) Patent No.: US 6,874,705 B2
(45) Date of Patent: Apr. 5, 2005

(54) NOISE-OPTIMIZED DEVICE FOR INJECTING FUEL

(75) Inventor: Marcus Parche, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 67 days.

(21) Appl. No.: 10/372,316

(22) Filed: Feb. 25, 2003

(65) Prior Publication Data

US 2003/0178001 A1 Sep. 25, 2003

(30) Foreign Application Priority Data

Feb. 25, 2002 (DE) ..... 102 07 974

(51) Int. Cl.[7] ..... F02M 39/00

(52) U.S. Cl. ..... 239/533.3; 239/88; 239/92; 239/96; 239/533.8; 123/446

(58) Field of Search ..... 239/88, 92, 96, 239/533.2, 533.3, 533.4, 533.8; 123/446, 447, 462

(56) References Cited

U.S. PATENT DOCUMENTS 4,750,462 A * 6/1988 Egler et al. ..... 239/88
4,979,676 A * 12/1990 Hehn ..... 239/533.8
5,219,122 A * 6/1993 Iwanaga ..... 239/533.8
6,305,359 B1 * 10/2001 Kronberger et al. ..... 239/96
6,598,811 B2 * 7/2003 Boecking ..... 239/533.2

* cited by examiner

*Primary Examiner*—Steven J. Ganey
(74) *Attorney, Agent, or Firm*—Ronald E. Greigg

(57) ABSTRACT

The invention relates to a unit injector system for supplying the combustion chamber of a self-igniting internal combustion engine with fuel. The unit injector system has a high-pressure chamber that can be subjected to pressure via a pump piston. A storage piston is received inside a storage chamber and is acted upon via a compression spring disposed in a spring holder. A return flow throttle element, which delays the buildup of pressure in the storage chamber, is disposed between the high pressure chamber and the storage chamber of the storage piston.

7 Claims, 2 Drawing Sheets

NOISE-OPTIMIZED DEVICE FOR INJECTING FUEL

BACKGROUND OF THE INVENTION

1. Field of the Invention

In systems for injecting fuel into the combustion chamber of internal combustion engines, component parts such as switching valves and injection nozzles in high-pressure pumps and in the various embodiments of injectors, nozzle holder combinations, or unit injector systems are made to move. Their motion positively displaces a volume which is replenished on the intake side. For the requisite volumetric flow, the pressures and cross sections must be adapted. If the replenishment of fuel is inadequate, the pressure on the intake side drops. If the vapor pressure of the fluid to be pumped fails to be attained, the column of liquid breaks off, causing cavitation bubbles to form. Upon recompression of the fuel to above the vapor pressure, the collapse of the vapor bubbles causes noise.

2. Description of the Prior Art

With present unit injector systems in self-igniting internal combustion engines, mechanically-hydraulically controlled preinjection phases are generated, which contribute on the one hand to reducing the noise of combustion and on the other to minimizing pollutants. In unit injector systems, a distinction can be made among four operating states. A pump piston is moved upward via a restoring spring. The fuel, which is at a constant overpressure, flows out of the low-pressure part of the fuel supply via the inlet bores, which are integrated with the engine block, and via the inlet conduit into the magnet valve chamber. The magnet valve is opened. Via a connecting bore, the fuel reaches the high-pressure chamber.

Upon a rotation of the driving cam, the pump piston moves downward. The magnet valve remains in its open position, and the fuel is forced by the pump piston via the inlet conduit back into the low-pressure part of the fuel supply.

In a third phase of the injection event, an actuator is triggered by the control unit at a specified instant, so that the actuator is pulled into a seat, and the communication between the high-pressure chamber and the low-pressure part is closed. This instant is also known as the "electrical injection onset". The high fuel pressure in the high-pressure chamber rises continuously as a result of the motion of the pump piston, and as a result a rising pressure is also established at the injection nozzle. Once a nozzle opening pressure is reached, lifting of the nozzle needle occurs, causing fuel to be injected into the combustion chamber. This instant is also called the "actual injection onset", or the supply onset. Because of the high pumping rate of the pump piston, the pressure continues to rise during the entire injection event. In a concluding operating state, the actuator is turned off again, after which the actuator opens after a slight delay, and the communication between the high-pressure chamber and the low-pressure part is opened again. As the actuator, magnet valves or piezoelectric actuators can for instance be used.

In this transition phase, the peak pressure is reached. After that, the pressure collapses very quickly. When it falls below the nozzle closing pressure, the injection nozzle closes and terminates the injection event. The remaining fuel pumped by the pump element until the apex point of the driving cam is forced into the low-pressure part via the return conduit.

Single-pump systems of the kind described above are intrinsically safe; that is, in the unlikely event of a fault or defect, no more than one uncontrolled injection can occur: If the magnet valve opens, injection cannot occur, since the flows back into the low-pressure part, and a pressure buildup cannot occur. Since the filling of the high-pressure chamber takes place exclusively via the actuator, when the actuator remains constantly in the closed state no fuel can reach the high-pressure chamber. As a rule, unit injector systems are built into the cylinder head and exposed to high temperatures. To keep the temperatures in the unit injector system as low as possible, cooling of the components of the unit injector system is as a rule done by means of fuel, which in turn flows back into the low-pressure part of the fuel injection system.

The total pressure $p_{tot}$ of a flowing medium is composed of a static pressure component $p_{stat}$ and a dynamic pressure component $p_{dyn}$. Except for pressure losses, caused for instance by friction, the total pressure established is constant. The kinetic pressure, conversely, is proportional to the square of the flow velocity, in accordance with the following equation:

$$P_{dyn} = \frac{\rho}{2} v^2$$

If the fuel in the pump of the unit injector system is accelerated sharply, the static pressure drops. In the process, it can drop below the vapor pressure, resulting in cavitation.

In the motion of the storage piston, both phenomena can occur. The motion of the storage piston leads to a compression of the fuel in the spring holder. This increases the counterpressure of the injection nozzle, which leads to the end of the preinjection phase. In addition, the compression increases the second opening pressure for the subsequent injection. To assure good emissions outcomes, fast opening of the storage piston is indispensable. From an acoustical standpoint, however, the fast opening is not critical, since then the intake side communicates with the element chamber, in which at this instant high pressure still prevails. Upon the return motion of the storage piston, the positively displaced volume must return into the spring holder. This return flow is effected either via a communication with the return, or a communication with the inflow loop. In the process, the fuel passes through a throttle, whose cross section has a certain value. If the throttle is enlarged, a residual pressure can be maintained as a function of the flow cross section. If the positively displaced volumetric flow is greater than the replenishing quantity, then the pressure in the spring holder drops. If when the pressure in the spring holder drops it drops below the vapor pressure, cavitation can occur.

In the return motion of the storage piston at the end of the injection event, the column of liquid above the storage piston is moved in the direction of the element chamber. At this instant, the pressure in the element chamber is already close to the vapor pressure, and as a result a fast return flow can occur. The high flow velocity can lead to undershooting of the vapor pressure so that once again cavitation can be the result.

European Patent Disclosure EP 0 404 916 B1 has a fuel injection nozzle as its subject. The fuel injection nozzle, embodied in particular as a pump-nozzle, includes a nozzle needle, which is urged in the closing direction by a spring. In the fuel injection nozzle, a pressure chamber upstream of the seat of the nozzle needle is in communication with a storage chamber that is defined by a spring-loaded compensation piston. The compensation piston (also called a storage piston), with its storage piston bush, forms a sealing seat. The storage chamber is located downstream of this sealing seat, as viewed from the pressure chamber. The storage piston, which has a cylindrical guide part, is subjected, on its end remote from the storage chamber, to the pressure in a damping chamber that can be filled with fuel, and it has a peg which dips into a plate that defines the damping chamber and has an opening. The cylindrical guide part of the storage piston has a ratio of the diameter to the height of 1:0.1 to 1:0.4; the peg of the storage piston has a variable cross section that dips into the boundary plate, and on its end toward the storage chamber, the storage piston has a guide extension with grooves.

OBJECT AND SUMMARY OF THE INVENTION

In the proposed embodiment, a delay in the storage piston return motion can be achieved, yet without significantly impairing the opening motion of the storage piston inside a unit injector system. To that end, a return flow throttle valve can be disposed in the region of the high-pressure communication of the storage chamber.

The return flow throttle valve is passable, viewed in the opening direction of the storage piston, so that the hydraulically controlled preinjection is unimpaired. After the end of the main injection, the high-pressure in the entire high-pressure volume drops so far that the closing pressure level of the storage piston is reached. When the closing pressure level is reached, the closing motion of the storage piston begins. If a return flow throttle valve is used, a pressure difference is established between the pressure on the storage piston side of the return throttle and the pressure on the high-pressure side, and this pressure difference causes a closure of the return throttle. A pressure reduction can in this case only occur in delayed fashion via the throttle restriction itself, so that the return motion is slowed down sharply.

By the design of the seat cross section, the stroke, the throttle cross section, and the spring adaptation of the return flow throttle element, the reverse motion of the storage piston, that is, the component motion that is definitive for the cavitation phenomena, can be delayed to such an extent that a replenishing flow of fuel into the interior of the spring holder occurs without cavitation, so that noise does not develop.

Instead of a return flow throttle valve, a check valve can be used in the unit injector system. Toward the end of the injection, the pressure on the high-pressure side drops, whereupon the check valve closes. The pressure in the reservoir remains at a high level, so that the storage piston remains in its open position. Leaks for production and tolerance reasons at the storage piston guide causes slow reduction in the pressure, until it drops below the closing pressure of the reservoir, and the storage piston closes slowly.

If the pressure always remains above the vapor pressure during the refilling of the hollow spring holder chamber, cavitation phenomena can be avoided, which favorably affects the noise developed in this kind of unit injector system.

BRIEF DESCRIPTION OF THE DRAWING

The invention will be better understood and further objects and advantages thereof will become more apparent from the ensuing detailed description of preferred embodiments taken in conjunction with the drawings, in which:

FIG. 3 shows the storage piston in its closed position;

FIG. 4 shows the opening of the sealing seat of the storage piston when its opening pressure is reached; and FIG. 5 shows the sealing off of a hollow chamber in the injector by an end face facing the sealing seat of the storage piston.

DESCRIPTION OF THE PREFERRED EMBODIMENTS

Figure 1:
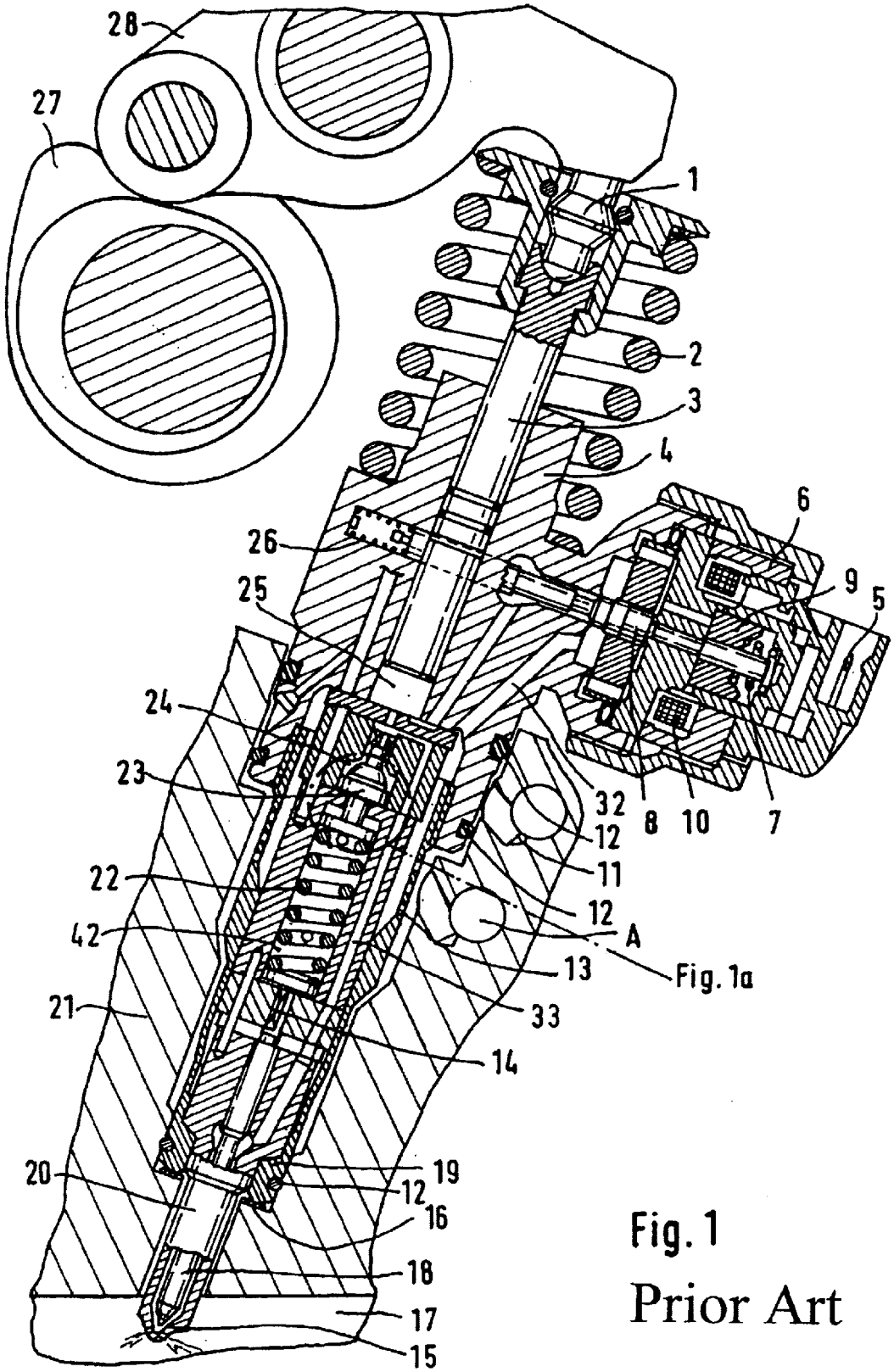
Fig. 1 Prior Art
FIG. 1 shows the general layout of a unit injector system for supplying fuel to the combustion chambers of a self-igniting internal combustion engine.

In the unit injector system shown in FIG. 1, a pump piston 3, which is received movably in a pump body 4, is actuated via a spherical bolt 1. The spherical bolt 1 in turn is actuated via a tiltably disposed tilt lever 28, which is provided on one of its ends with a rotatably supported roller body. The roller body rolls along a cam of a driving camshaft 27. The deflection of the tilt lever 28 about its pivot axis depends on the course of the shaping of the top of the cam, which in the view of FIG. 1 extends eccentrically to the pivot axis of the driving camshaft 27.

The pump piston 3 of the pump body 4 of the unit injector system is acted upon by a restoring spring 2, which is braced on one end on a plane face of the pump body 4 and on the other on a caplike support element, which is disposed in the upper region of the pump piston 3 that is movable in the pump body 4.

Laterally of the pump body 4 is an actuator, which in the exemplary embodiment shown in FIG. 1 includes a magnet coil 10. The magnet coil 10 of the actuator acts on an armature 9, which in turn acts on a magnet valve needle. The armature 9 of the actuator is acted upon by a compensation spring 7. Reference numeral 6 indicates the magnet core, which surrounds the magnet coil 10 of the actuator.

A fuel return 11 is shown below the actuator; by way of it, excess fuel flowing out of the unit injector system can return into a low-pressure region, not further shown in FIG. 1, such as the tank of a motor vehicle. In the fastening region at the cylinder head of the engine, the unit injector system is sealed off by way of sealing elements 12. Inside the unit injector system, inlet bores 13 are embodied in the wall, and by way of them fuel flows from a low-pressure-side fuel forward flow, to a valve chamber of an actuator, embodied here as a magnet valve, to the element chamber 25. As a result of the pressures applied, fuel is conducted through the pump body 4 for cooling the actuator and, via a bore system embodied in the pump body 4, it reaches a chamber defined by two sealing rings 12, and from there it is carried away via the fuel return marked 11. Via the fuel return in the unit injector system as shown in FIG. 1, the leak fuel in the pump piston 3 can be carried away; moreover, by means of throttle restrictions embodied in the return system, vapor bubbles can be removed.

Reference numeral 14 indicates a hydraulic stop, which functions as a damper. Extending below the hydraulic stop is a nozzle needle 18, which is partly surrounded by an integrated injection nozzle body 20. The nozzle needle 18, in its front region pointing toward a combustion chamber 17, is seated inside a needle seat 15. By means of a lock nut 19, the unit injector system and the integrated injection nozzle 20 partly surrounding the nozzle needle 18 communicate with one another; below the lock nut 19, there is a sealing disk 16, for sealing off the combustion chamber 17 of a self-igniting internal combustion engine from the cylinder head of the engine. The cylinder head of the self-igniting engine is marked 21.

Within the unit injector system as shown in FIG. 1, a hollow chamber 42 of a spring holder is provided, which receives a compression spring 22, embodied for instance as a spiral spring. The compression spring 22 is braced by its lower end on a disklike insert in the hollow chamber 42 of the spring holder, and with its opposite end it acts on a storage piston 23. The storage piston 23, embodied for instance in two parts, including a peglike element and a disk, is enclosed inside the unit injector system by a storage chamber 24. The disk can be embodied as a separate component. The storage chamber 24 of the storage piston 23 and the hollow chamber 42 of the spring holder are in fluidic communication with one another, via an opening 31 shown enlarged in FIG. 1*a*.

The pump piston 3, which is movable vertically up and down via the tilt lever 28, acts upon a high-pressure chamber 25 within the unit injector system, which is also known as an element chamber. Below the disklike component that demarcates the high-pressure chamber 25, a high-pressure inlet branches off to the nozzle chamber and acts upon the nozzle needle 18 on the end toward the cylinder head of the unit injector system. From the nozzle chamber, the fuel, which is at high pressure, flows via an annular gap in the direction of the needle seat 15, and from there, upon an upward motion of the nozzle needle 18, it is injected into the combustion chamber 17 of the self-igniting engine within a preinjection and a main injection.

For the sake of completeness, it should be noted that reference numeral 26 indicates a magnet valve spring, which urges the magnet valve needle 8 in the restoring direction.

Figure 1A:
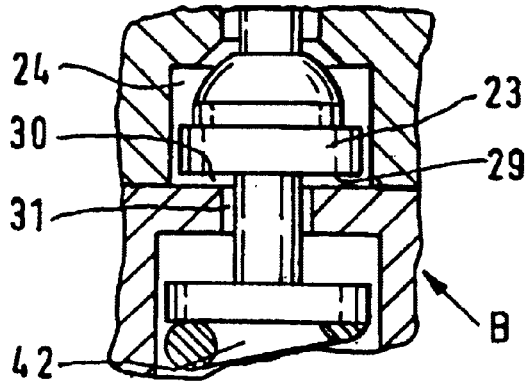
Fig. 1a Prior Art
FIG. 1*a* is an enlarged view of the fluidic communication between the storage chamber and the hollow chamber of the spring holder in the prior art shown in FIG. 1.

In FIG. 1*a*, an enlarged view of the region of the unit injector system shown in FIG. 1 can be seen, in which the opening 31 between the storage chamber and the hollow chamber of the spring holder is shown on a larger scale.

As can be seen from the view in FIG. 1*a*, the storage piston 23 is surrounded by the storage chamber 24 and is acted upon by fuel, which is at high pressure, from the high-pressure side that is emerging from the high-pressure chamber 25. By the downward motion of a face end 29 of the storage piston 23, as it is acted upon by high pressure via the high-pressure chamber 25, the fuel in the hollow chamber of the spring holder 42 is compressed. As a result, the counterpressure on the injection nozzle increases, bringing about an end of a preinjection phase. To assure high-quality emissions outcomes, fast opening of the storage piston 23 is required. Upon fast opening of the storage piston 23, the intake side of the storage piston 23 is in communication with the high-pressure chamber 25. At that instant, high pressure prevails inside the high-pressure chamber 25.

In the return motion of the storage piston 23, the positively displaced volume must return into the hollow chamber 42 of the spring holder. This can be done either via a communication with the return or at the inflow loop. If the positively displaced fuel volume is greater than the replenished quantity, the pressure in the hollow chamber 42 of the spring holder drops. If it drops below the vapor pressure, cavitation occurs. Also in the return motion of the storage piston 23 at the end of an injection event, the liquid column above the storage piston 23 is moved in the direction of the high-pressure chamber 25. At that instant, the pressure inside the high-pressure chamber 25 is already in the vicinity of the vapor pressure, and as a result a fast return flow occurs. The high flow velocity of this return process causes the pressure to drop below the vapor pressure, and thus can once again cause cavitation.

Figure 2:
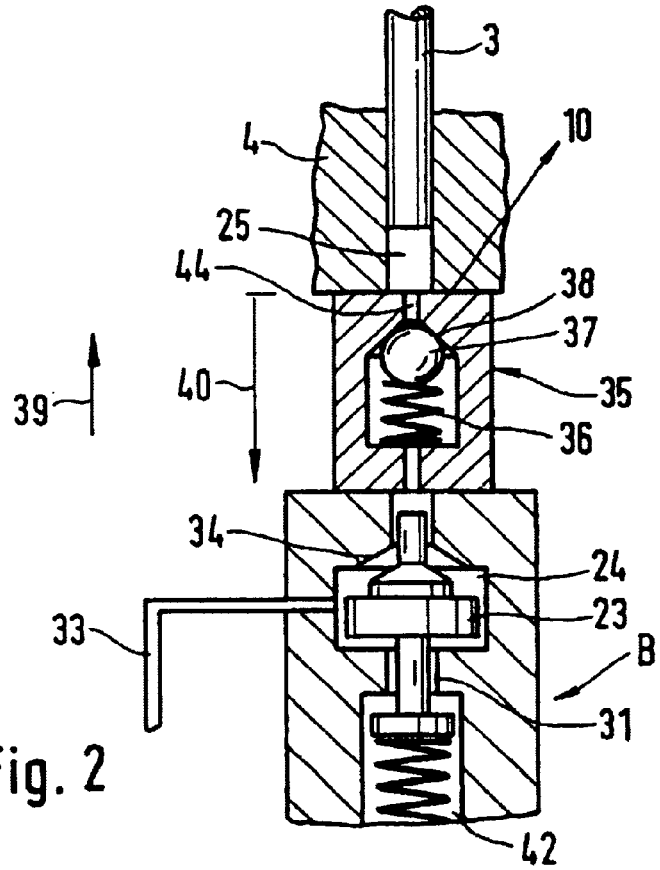
FIG. 2 shows the return flow throttle unit, disposed between the storage piston chamber and the hollow spring holder chamber, for delaying the closing motion of the storage piston.

FIG. 2 schematically shows a return flow throttle element, disposed between the storage chamber and the hollow chamber of the spring holder, for delaying the motion of the storage piston.

FIG. 2, in highly simplified form, shows a return flow throttle valve 35, which is disposed between the storage chamber 24 of the storage piston 23 and the element chamber 25 of the spring holder. By means of the return flow throttle valve 35, the possibility exists of slowing down the return motion of the storage piston 23, without substantially altering the opening motion, which should occur with the least possible hindrance, of the storage piston 23. The return flow throttle valve 35, which is shown schematically in the view in FIG. 2, includes a valve body 37, which is acted upon by a spring element 36, and a permanently operative throttle restriction 44, by way of which the storage chamber 24 of the storage piston 23 and the element chamber 25 are in fluidic communication with one another.

Once the pressure difference between the element chamber 25 and the storage chamber 24 of the storage piston 23 has caused the return flow throttle valve 35 to close, the pressure in the storage chamber 24 slowly decreases in the direction of the element chamber 25. Because of the slow decrease, the motion of the storage piston 23 inside the storage chamber 24 is slowed down, so that replenishing fuel, for instance from the inlet bores 13, can flow fast enough into the hollow chamber 42 of the spring holder B fast enough that the pressure there does not drop below the vapor pressure. If the pressure is kept above the vapor pressure there, no cavitation occurs, and so cavitation-free operation can be achieved.

The return flow throttle valve 35 allows an unhindered opening motion of the storage piston 23 in the storage chamber 24, since the return flow throttle valve 35 is passable in the second direction 40. After the end of the injection, the high pressure in the entire high-pressure volume, that is, inside the element chamber 25, drops so far that the closing pressure of the storage piston 23 is reached, and its closing motion begins. Because of a pressure difference that arises between the pressure on the reservoir-side end of the return flow throttle valve 35 and the pressure on the high-pressure side of the return flow throttle valve 35, that is, on the side pointing toward the element chamber 25, the return flow throttle valve 35 closes.

When a return flow throttle valve 35 with a throttle restriction 44 is used, only the throttle restriction 44 remains open after the closure of the closing element 37; the pressure reduction can be varied by means of how this throttle restriction is designed in terms of the flow cross section. Delaying the pressure reduction in the direction of the element chamber 25 delays the motion of the storage piston 23 inside the storage chamber 24. Because of the delayed course of the return motion of the storage piston 23, refilling of the hollow chamber 42 of the spring holder B takes place via inlet bores 13 in such a way that in this region no cavitation occurs, since the pressure can be kept above the vapor pressure level.

By means of the design of the seat cross section 38 at the return flow throttle valve 35, its stroke, and the design of the throttle cross section of the throttle restriction 44 and the spring prestressing by the spring element 36, the motion of the storage piston 23 can be slowed down to such an extent that the refilling of the hollow chamber 42 of the spring holder takes place in a way that avoids cavitation.

FIG. 3 shows a storage piston in its closing position on the sealing seat.

It can be seen from FIG. 3 that the storage piston 23 has moved by a stroke length 41 into its sealing seat 34 toward the element chamber 25. The hollow chamber 42 of the spring holder B is in communication, via the opening 31, with part of the storage chamber 24, and an end face 29 on the underside of the storage piston 23 has been placed at the distance of the stroke length 41 from the bottom of the storage chamber 24, in the position shown in FIG. 3. In this position of the storage piston 23, the storage piston disconnects the element chamber 25 from the storage chamber 24.

FIG. 4 shows the opening of the sealing seat at the storage piston when its opening pressure is reached. When the opening pressure level of the storage piston 23 is exceeded, the sealing seat, marked 34, on the top of the storage piston 23 opens. The storage chamber 24 of the storage piston 23 is now filled via the opened sealing seat 34 and via the element chamber, and the storage piston 23 moves in the direction of the hollow chamber 42 of the spring holder B.

FIG. 5 shows the sealing off of the hollow chamber of the spring holder B by an end face, facing the sealing seat, of the storage piston.

It can be seen from FIG. 5 that the end face 29 of the storage piston 23 rests on the opening 31 that connects the storage chamber 24 and the hollow chamber 42 of the spring holder B to one another. From FIG. 5, it can be seen that the storage piston 23 now seals off the storage chamber 24, which in turn is in communication with the element chamber 25, from the hollow chamber 42 of the spring holder B.

In terms of the design of the seat cross section 38 of the return flow throttle valve 35 and of the stroke length 41 of the storage piston 23, these should be designed such that the opening motion of the storage piston 23, in the phase shown in FIGS. 4 and 5, should proceed virtually unhindered. In the opening phase of the storage piston 23 in the direction marked 40 in FIG. 2, the storage chamber 24 is filled first, and after it, the volume that results from the product of the storage piston end face 29 and the stroke length 41 of the storage piston. Design:

$$V_{total} = V_{storage\ chamber\,24} + \left(\frac{\pi\phi\ \text{end face}\ 29^2}{4} \times h_{storage\ piston}\right)$$

Calculating the reservoir volume from the seat face area and the stroke length depends on how the valve is designed, for instance whether a cone seat or a ball seat is involved, which can mean different seat face diameters or averaged seat face diameters.

It is advantageous to select as short as possible a stroke length of the return flow throttle valve 35, or of an alternatively usable check valve, so that the entire opening cross section can already be attained after only a brief opening time.

In terms of the design of the spring element 36 of the return flow throttle valve 35, the goal is to design the spring prestressing of the spring element 36 such that the return flow throttle valve 35 can be kept in a defined prestressed position in the pressureless state, and a fast closing motion is reinforced upon closure of the return flow throttle valve 35.

The task of the throttle cross section of the throttle restriction 44 embodied on the return flow throttle valve 35 is to slow down the pressure relief of the storage chamber 24 in the direction of the element chamber 25 in such a way that no cavitation occurs in the hollow chamber 42 of the spring holder B. On the other hand, a pressure relief of the storage chamber 24 in the direction of the element chamber 25 should be attained that is fast enough that at the onset of the next injection cycle, the original pressure ratios, or in other words, a pressure equilibrium, is established soon enough.

In a further variant embodiment of the concept on which the invention is based, a check valve can be used. The check valve, for instance containing a spherically shaped closing element 37, which is acted upon by a spring element, preferably a spiral spring 36, forms the limit shape of a return flow throttle element, in which the throttle is closed in the limit case. At the end of injection, the pressure in the high-pressure chamber 25 is subjected to high pressure by the pump piston 3, in accordance with its reciprocating motion. With the check valve closed, the pressure on the reservoir side 24 remains at such a high level that the storage piston 23 stays in its opening position. From leakage at the storage piston guide, which necessarily occurs because of production and tolerance reasons, the pressure slowly drops until it falls below the closing pressure of the reservoir, and the storage piston 23 slowly begins its closing motion. Depending on the pressure drop attainable, and because of a pressure reduction via the leakage gaps, the pressure buildup occurs so slowly that the refilling of the spring holder 42 proceeds such that the pressure level inside the hollow chamber of the spring holder 42 can be kept above the vapor pressure at all times, so that no cavitation can occur inside the hollow chamber 42 of the spring holder, and thus a considerable noise abatement can be attained by avoiding vapor bubble formation in the fuel.

In both variant embodiments, that is, when a return flow throttle valve is used as the return flow throttle element and when a check valve is used as the return flow throttle element, it is attainable that by the integration between the element chamber 25 and the storage chamber 24 of the storage piston 23, a delay in the restoring motion of the storage piston 23 can be attained. By reducing the speed of motion of the storage piston 23 within the unit injector system, a drop in the pressure level inside the unit injector system in the hollow chamber 42 of the spring holder B to below the vapor pressure can be effectively prevented. Since with the embodiment proposed according to the invention no vapor bubble formation or in other words cavitation can occur inside the hollow chamber 42 of the spring holder B, a substantially quieter operation of the unit injector system is possible when the embodiment proposed according to the invention is used, even in high rpm ranges of the unit injector system.

The foregoing relates to preferred exemplary embodiments of the invention, it being understood that other variants and embodiments thereof are possible within the spirit and scope of the invention, the latter being defined by the appended claims.

I claim:

1. A unit injector system for supplying the combustion chamber (17) of an internal combustion engine with fuel, having a high-pressure chamber (25) that can be subjected to pressure via a pump piston (3), and having a storage piston (23), received inside a storage chamber (24), that is acted upon via a compression spring (22) disposed in a spring holder chamber (42), characterized in that disposed between the element chamber (25) and the storage chamber (24) of the storage piston (23) is a return flow throttle element (35), which return flow throttle element (35) is passable in a second direction (40) corresponding to the opening direction of the storage piston (23), and characterized in that the return flow throttle element (35) reduces the closing direction of the storage piston (23) in a first direction (39) corresponding to the closing direction of a storage piston (23), so that the return flow throttle element delays the buildup of pressure in the storage chamber (24).

2. The unit injector system of claim 1, characterized in that the return flow throttle element (35) is embodied as a return flow throttle valve.

3. The unit injector system of claim 1, characterized in that the return flow throttle element (35) is embodied as a check valve.

4. The unit injector system of claim 2, characterized in that at a pressure difference $\Delta_p$ that comes to be established above the return flow throttle element (35) between the element chamber (25) and the storage chamber (24), the return flow throttle element (35) closes in such a manner that a pressure reduction is now effected only via a throttle restriction (44) of the return flow throttle element (35).

5. The unit injector system of claim 1, characterized in that a sealing seat (34) that opens or uncovers the element chamber (25) toward the storage chamber (24) embodied on the storage piston (23).

6. The unit injector system of claim 1, characterized in that an end face (29) that closes an opening (31) of a hollow chamber (42) of a spring holder (B) is embodied on the storage piston (23), on the side oriented toward the hollow chamber (42).

7. The unit injector system of claim 1, characterized in that a peg dips into the opening (31) to the hollow chamber (42) is embodied on the storage piston (23).

* * * * *